United States Patent [19]

Wessells et al.

[11] 4,407,862

[45] Oct. 4, 1983

[54] METHOD OF MAKING LETTERPRESS PRINTING PLATES

[75] Inventors: Forrest Wessells, Deltona; Joseph Startari, Tallahasse, both of Fla.; Michael E. Estes, Marietta, Ga.

[73] Assignee: W. R. Grace & Co., Cambridge, Mass.

[21] Appl. No.: 316,386

[22] Filed: Oct. 29, 1981

Related U.S. Application Data

[63] Continuation-in-part of Ser. No. 228,638, Jan. 26, 1981, abandoned, which is a continuation of Ser. No. 910,721, May 30, 1978, abandoned, which is a continuation-in-part of Ser. No. 892,438, Mar. 31, 1978, abandoned.

[51] Int. Cl.[3] ..... B41L 7/00; B41L 9/00

[52] U.S. Cl. ..... 427/144; 101/395; 101/401.1; 427/145; 427/348; 427/411; 428/537; 428/908; 428/909; 430/306; 430/309

[58] Field of Search ..... 427/144, 145, 146, 348, 427/395, 411; 428/908, 909, 537; 430/309, 306; 101/395, 401.1; 134/37; 162/162

[56] References Cited

U.S. PATENT DOCUMENTS

| | | | |
|---|---|---|---|
| 2,760,863 | 8/1956 | Plambeck, Jr. | 95/5.6 |
| 2,961,342 | 11/1960 | Snyder | 117/76 |
| 3,615,450 | 10/1971 | Weber et al. | 96/35.1 |
| 3,635,711 | 1/1972 | Miller | 96/35.1 |
| 3,640,219 | 2/1972 | Farnham et al. | 101/401.1 |
| 3,672,888 | 6/1972 | Hasegawa et al. | 96/1.8 |
| 3,733,200 | 5/1973 | Takaishi et al. | 96/86 |
| 3,922,751 | 12/1975 | Wessells et al. | 15/306 |
| 4,120,721 | 10/1978 | Ketley et al. | 427/44 |

FOREIGN PATENT DOCUMENTS

| | | |
|---|---|---|
| 733409 | 12/1953 | United Kingdom . |
| 824148 | 12/1957 | United Kingdom . |
| 883811 | 4/1960 | United Kingdom . |
| 905182 | 12/1960 | United Kingdom . |
| 1042519 | 6/1963 | United Kingdom . |
| 1141475 | 6/1966 | United Kingdom . |
| 1251232 | 10/1968 | United Kingdom . |
| 1252370 | 10/1969 | United Kingdom . |

*Primary Examiner*—S. L. Childs

*Attorney, Agent, or Firm*—Carole F. Barrett; Edward J. Hanson, Jr.; William L. Baker

[57] ABSTRACT

A method of preparing a letterpress printing plate from a liquid photopolymer using an air knife to etch out the unpolymerized liquid to leave the relief image. A new printing plate substrate is used that has a laminae that is paper and a lamina that is a sealing coat on the paper. The paper is a special paper known as tag stock that is 5 to 20 mils thick, has tensile strengths of at least 30 pounds per inch in width in the press direction and at least 20 pounds per inch in width in the cross press direction, and fibers that are independently colored with a dark color having a good light absorption/reflectivity ratio.

4 Claims, No Drawings

METHOD OF MAKING LETTERPRESS PRINTING PLATES

BACKGROUND OF THE INVENTION

This application is a continuation-in-part of copending application U.S. Ser. No. 228,638, filed 1-26-81 now abandoned; which was a continuation of copending application U.S. Ser. No. 910,721, filed May 30, 1978, now abandoned; which was a continuation-in-part of copending application U.S. Ser. No. 892,438 filed Mar. 31, 1978, now abondoned.

The present invention relates to a method of making letter-press printing plates using photopolymers that are liquid when relief photo-cured and mechanically etched with a liquid free procedure to provide the relief on a paper substrate.

In the past, letterpress printing plates of the photopolymertype have usually had aluminum, mylar and steel substrates. The use of paper substrates was suggested prior to the time of the present invention, but insofar as is known none were successfully used. Paper substrates have been well known for many years for use with mimeograph and lithographic, or offset printing devices. Mimeograph and offset printing have, in the instances where paper substrates are used, been for relatively short runs, usually less than 25,000 impression insofar as we are aware. Letterpress printing plates on the other hand are normally subjected to 500,000 plus impressions. Furthermore, insofar as is known, the paper used for mimeograph and offset printing would not have been tag stock.

The earlier letterpress printing plate substrates of aluminum, mylar and steel had various coatings on them including PVCD compositions. Some of the coatings were clear and others contained colorants. Some contained black pigment.

The letterpress printing plates of the present invention contain a substrate that resists elongation much better than the mylar substrates of the prior art while having much better compression properties than the aluminum and steel substrates of the prior art. The letterpress printing plates of the present invention are more easily disposed of after they have been used and the substrate is substantially lighter in weight and is predominately composed of a renewable resource, natural pulp. In addition the letterpress printing plates of the present invention are less costly.

SUMMARY OF THE INVENTION

The present invention relates to letterpress printing plates that are formed using light polymerizable compositions that are relief imaged as a liquid with the non-polymerized liquid being mechanically removed to etch the plate using non-liquid means such as an air knife. A special substrate has been provided for producing such letterpress printing plates. The substrate consists of two laminae. A paper lamina and a sealing lamina sealing the side of the paper that is to serve as the working support for preparing the letterpress printing plate. The paper is characterized by cellulosic pulp and consists of a single sheet of smooth finish tag stock that is 5 to 20 mils thick, has a tensile strength in the press direction of at least 30 pounds per inch in width, a tensile strength in the non-press direction of at least 20 pounds per inch in width and has dark colored fibers that are independently colored with a dark color having a good light absorption/-reflectivity ratio before being incorporated into the sheet.

DESCRIPTION OF THE PREFERRED EMBODIMENT

The method of the present invention involves preparing a letterpress printing plate by positioning a substrate for receipt of a liquid actinic light polymerizable printing plate relief forming layer and depositing the actinic light polymerizable liquid composition on the substrate. The substrate is made up of a paper lamina and a polymeric sealing lamina. The paper lamina must be sealed on the side or surface on which the light polymerizable liquid composition is deposited with a polymeric coating. The paper laminae is characterized by its cellulosic pulp and must be a single sheet of smooth finished tag stock, be 5 to 20 mils thick, have a tensile strength in the press direction of at least 30 pounds per inch in width, more preferably 70 pounds, and have a tensile strength in the cross press direction of at least 20 pounds per inch in width. The fibers in the substrate must be independently colored with a dark color having a good light absorption/reflectivity ratio.

The liquid composition deposited on the substrate is maintained as a liquid on the substrate and in liquid state exposed to light with a patterning means to polymerize said light polymerizable composition and form a latent relief image therein. This latent image is preferably a solidified portion in the surface of the liquid relief forming light polymerizable composition. The relief image is then formed in the composition by etching out the portion that is not intended to form the raised portion of the relief. This must be done by a mechanical, liquid free developing procedure to remove the still liquid material that is not polymerized to a solid by exposure to the light. Liquid etchants would damage paper substrates characterized by cellulosic fibers because such substrates are damaged by the usual etching solutions when they are applied with sufficient vigor and/or length of time to thoroughly etch a letterpress printing plate. The preferred mechanical, lequid free developing procedure is the use of air etching, preferably by means of an air knife. The air knife forcefully stripe away the uncured liquid polymer and provides the desired printing configuration.

As stated in the previous paragraph, in the present invention it is necessary to use light polymerizable liquid compositions that are applied directly to the substrte and subjected to exposure to light, generally actinic light, to form a latent relief image while the composition is still liquid. Examples of such compositions are those having chain extended urethane monomers with terminal unsaturation, diacrylate monomers and photoinitiators and thiols such as the compositions illustrated in U.S. Patents 3,615,450 and 4,120,721.

Conventional commercial equipment may be used to practice the present invention. A U.S. patent depicting conventional commercial equipment is U.S. Pat. No. 3,635,711 the content of which is incorporated herein by reference. The photopolymerizable layer is provided on the substrate to form the blank printing plate. Thereafter the blank is imaged conventionally through a negative and the plate is air etched in conventional manner as is for example shown in U.S. Pat. No. 3,922,751, the content of which is incorporated herein by reference. In the preferred practice of the invention, the plate is dry developed or etched because this better maintains the integrity of the fiberous sheet of the substrate. After the development of the plate, it can be installed on a letterpress for the printing operation.

The cellulosic pulp in the substrate is a natural cellulosic pulp. The tag stock is preferably of the type called a cover stock and has relatively low porosity. 5 to 20 mils thick tag stock is also known as 5 to 20 point stock. In a 10 mil thick sheet a basis weight of about 150 pounds is appropriate. (Basis weight is the weight of 500 sheets sized 24 inches by 36 inches). By the tag stock being characterized by cellulosic pulp, it is meant that the stock is predominately cellulosic pulp. It may also contain fillers and the like including fine fiberous fillers in small quantities.

The fibers in the tag stock are independently colored before incorporation into the sheet. Generally this is done by incorporating the colorant into the pulp before forming the pulp into a sheet.

The polymeric coating that seals the surface of the sheet stock preferably also provides superior adhesion of the radiation polymerizable relief forming layer. The coating is preferably a polymeric coating tie coat, more preferably a vinyl coating, and most preferably of the PVCD type. By PVCD it is meant the various vinylidene chloride copolymer coatings and by vinyl it is meant to include all such vinylidene chloride copolymers as well as polyvinyl chloride coatings. It is particularly desirable to apply such a vinyl coating as a polyvinylidene chloride latex.

The sealing coating is preferably at least substantially clear if not almost completely clear. Actually the polymer itself in a thick layer would be somewhat opaque but in a thin coating appears almost totally clear so that the light absorption/reflectivity of the tag stock is the controlling factor in the substrates light absorption/reflectivity properties.

EXAMPLES

The invention is further illustrated by the following examples:

The relief image printing pltes of the follwing examples were made with a standard LETTERFLEX ® 135 Platemaking System (a product of W. R. Grace & Co.) except where noted. Standard production process procedures were used. The control was the standard 0.009" aluminum sheet coated with a solvent base PVCD tie coat universally used in the newspaper printing industry. The relief forming polymers used are those produced by W. R. Grace & Co. and classified as Thiolenes. Unless otherwise indicated the polymer was that sold as Letterflex C polymer.

Relative responses in the formation of the relief face differentiating the different support members are characterized by:

- o Exposure time—a short exposure time, i.e. high productivity is desirable.
- o Angle—profile of the image derived by the intercept generated by the slope of the image. The smaller the angle the better the printing, i.e., crisp and clear.
- o S, E and EΔ—Characterize the response of the screened wedge that would be representative of halftone image extremes, i.e., percentile highlight dot through shadow dots that would be representative of halftone printing. The image used was a GAM target recognized as a definitive exposure characterization tool in the industry.

S—The step stablized.

E—Step of finest dot held.

EΔ—Number of steps held between the point of stabilization and the finest dot.

The target was constructed such that the higher the step number the larger the dot, and conversely the lower the step number the smaller the dot. The negative was composed of a GAM target, resolution images, wedges and typical type face that would be encountered in the newspaper industry.

EXAMPLE I

Two types of paper compositions were evaluated and compared with the control which was coated with a PVCD solvent base tie coat manufactured by Mobile Chemical Company; A jute tage stock, 10 point board, coated with a PVCD solvent base tie coat manufactured by Minnesota, Mining and Manufacturing Co.; and a Regal 20th Century Black 10 point cover stock coated with a PVCD solvent base tie coat manufactured by Dow Chemical Co. It is not considered that the different manufacture of the tie coat is significant.

| Sample | Character | Angle | S | E | EΔ |
|---|---|---|---|---|---|
| Control | Bold line | 101 | 10½ | 6 | 4½ |
| | Thin line | 71 | | | |
| Jute Stock | Bold line | 87 | 10½ | 7½ | 3 |
| 5 mil dot | Thin line | 85 | | | |
| stab. | | | | | |
| Cover Stock | Bold line | 85 | 9½ | 5 | 4½ |
| 4 mil stab. | Thin line | 70 | | | |
| Cover Stock | Bold line | 90 | 10½ | 5½ | 5 |
| 5 mil stab. | Thin line | 88 | | | |
| Cover Stock | Bold line | 91 | 13½ | 6 | 7.5 |
| 6 mil stab. | Thin line | 75 | | | |

5 mil dot = 10½

A 3 and 4 mil dot (stab.) stabilized represents over exposure. A 5 mil dot represents a typical correct exposure and a 6 mil dot indicates under exposure. Stabilization is the condition where highlight dots are joined at the base. This example illustrates an extended range of image response viability of both jute stock and cover stock papers as compared to the standard or control. Thus the operators making plates have a greater range and flexability in setting process parameters.

EXAMPLE II

The following coatings were applied to a jute stock base. The principal variables here are tie coat formulation and application procedures. AI type was DARAN ® 229+2% carbon black, AH was Daran 220+2% carbon black. Both Darans are polyvinylidene chloride latices produced by W. R. Grace & Co. Examples identified as XB5764 represent differences in coating procedures. The coating procedures were carried out at Minnesota, Mining and Manufacturing Co. on standard commercial roller coating production lines at temperatures ranging from about 200 to 220° F. and at various commercially practicable speeds and demonstrated that the products ultimate manufacture would be insensitive to reasonable production variabilities. Method A exhibited the application of 0.76 grams/ft.$^2$ and Method C exhibited the appllication of 0.74 grams/ft.$^2$. XB5764 is a product designation of Minnesota, Mining and Manufacturing Co. for a PVC—polyvinylidene chloride solvent solution containing some carbon black.

| Sample | Character | Angle° | S | E | EΔ | Adhesion |
|---|---|---|---|---|---|---|
| AI | Bold line | 78° | 6 | 2 | 3 | Excellent |
| 3 mil dot | Thin line | 60° | | | | |
| AI | Bold line | 82° | 7½ | 3 | 4½ | Excellent |
| 4 mil dot | Thin line | 57° | | | | |
| AI | Bold line | 73° | 12 | 6 | 6 | Good |
| 5 mil dot | Thin line | 46° | | | | |
| AH | Bold line | 73° | 6 | 3½ | 2½ | Excellent |
| 3 mil dot | Thin line | 58° | | | | |
| AH | Bold Line | 73° | 7½ | 3½ | 4 | Excellent |
| 4 mil dot | Thin line | 49° | | | | |
| AH | Bold line | 60° | 12 | 5 | 7 | Good |
| 5 mil dot | Thin line | 35° | | | | |
| XB5764 A Coat. | Bold line | 73° | 6 | 5½ | 1½ | Good |
| 3 mil dot | Thin line | | | | | |
| XB5764 A Coat. | Bold line | 100° | 7 | 5 | 2 | Excellent |
| 4 mil dot | Thin line | 62° | | | | |
| XB5764 A Coat. | Bold line | 76° | 12 | 6 | 6 | Good |
| 5 mil dot | Thin line | 52° | | | | |
| XB5764 C Coat. | Bold line | 92° | 7½ | 4 | 3½ | Good |
| 3 mil dot | Thin line | 72° | | | | |
| XB5764 C Coat. | Bold line | 82° | 7½ | 6 | 1½ | Good |
| 4 mil dot | Thin line | 74° | | | | |
| XB5764 C Coat. | Bold line | 72° | 12½ | 6 | 6½ | Good |
| 5 mil dot | Thin line | | | | | |
| Control | Bold line | 82° | 6 | 3 | 3 | Excellent |
| 3 mil dot | Thin line | 60° | | | | |
| Control | Bold line | 82° | 7½ | 4 | 2½ | Excellent |
| 4 mil dot | Thin line | 63° | | | | |
| Control | Bold line | 66° | 12 | 4½ | 7½ | Excellent |
| 5 mil dot | Thin line | | | | | |

5 mil dot = step 12; 4 mil dot = step 7½; 3 mil dot = step 6

EXAMPLE III

To test the preferability of a wider range of tie coats the following coatings were applied to a 108 lb/3000 sq. ft. basis weight flat paper from Mosinee Paper Company sold as 635D. The coating was applied in two coats, each 1/5 of an oz./sq. yd. AG was Daran 212 with 2% carbon black; AH was Daran 220 with 2% carbon black; AI was Daran 229 with 2% carbon black and AH was Daran 212 with 5% carbon black. The Darans are all polyvinylidene chloride latices produced by W. R. Grace & Co. AK–AO were all combinations of GEON® 352 and Geon 552 which are vinyl chloride coatings produced by Goodrich Tire and Rubber Co. The ratio of 352 to 552 was as follows AK-50/50; AL-60/40; AM-70/30; AN80/20; AO-90/10; AP was 100% Geon 352.

| Sample | Character | Angle | S | E | EΔ | Adhesion |
|---|---|---|---|---|---|---|
| Control | Bold line | 87 | 12 | 5 | 7 | Excellent |
| | Thin line | 83 | | | | |
| AG | Bold line | 106 | 12 | 5 | 7 | Fair |
| | Thin line | 82 | | | | |
| AH | Bold line | 82 | 12 | 5 | 7 | Good |
| | Thin line | 80 | | | | |
| AI | Bold line | 83 | 12 | 4 | 8 | Good-Excellent |
| | Thin line | 74 | | | | |
| AJ | Bold line | 87 | 12 | 6 | 6 | Good-Excellent |
| | Thin line | 78 | | | | |
| AK | Bold line | 100 | 12 | 8 | 4 | Good |
| | Thin line | 86 | | | | |
| AL | Bold line | 100 | 12 | 9 | 3 | Excellent |
| | Thin line | 86 | | | | |
| AM | Bold line | 60 | 11 | 7 | 4 | Good |
| | Thin line | 49 | | | | |
| AN | Bold line | 84 | 12 | 5 | 7 | Excellent |
| | Thin line | | | | | |
| AO | Bold line | 90 | 12 | 7 | 5 | Fair |
| | Thin line | 83 | | | | |
| AP | Bold line | | 13 | 13 | 0 | Poor |

-continued

| Sample | Character | Angle | S | E | EΔ | Adhesion |
|---|---|---|---|---|---|---|
| | Thin line | | | | | |

From this example it was determined that vinylidene chloride latices tie coatings were preferable and that such coatings should preferably not have carbon black contents as great as 5%.

EXAMPLE IV

A composite material supplied by Ludlow Corporation consisting of a board composed of cellulosic fibers intergrated with polymeric fiber, 10/1000 or an inch thick and moderate density was used as the support member.

| Sample # | Character | Vertex | Character Width | Print Surface | Shoulder Depth | S | E | EΔ |
|---|---|---|---|---|---|---|---|---|
| 1 | . (dot) | $68^5$ | 54 | 39 | $10^5$ | 14 | 14 | ½ |
| 2 | 1 (#1) | $76^5$ | 51 | 37 | $9^5$ | | | |

EΔ can be seen here as one limitation for this type of composite.

EXAMPLE V

Physical properties of various papers were determined on an Instron according to TAPPI method T 494 os-70 which gives pounds per 1 inch wide and dividing this measurement by the thickness of the sample yielding pounds per square inch or psi. The results are as follows:

| | | Modulus | Tensile | Elongation | Average |
|---|---|---|---|---|---|
| Manila Tag | (length) | 643,200 | 6,920 | 2.0 | M 651,733 |
| produced by | | 672,000 | 7,160 | 2.0 | T 7,067 |
| Fouridier | | 640,000 | 7,120 | 2.0 | E 2.0 |
| process | (width) | 290,400 | 4,000 | 5.5 | M 295,733 |
| | | 286,400 | 3,600 | 4.0 | T 3,627 |
| | | 310,400 | 3,280 | 3.5 | E 4.3 |
| 20th Century | (length) | 533,333 | 13,440 | 3.5 | M 534,755 |
| | | 537,600 | 12,267 | 3.0 | T 13,049 |
| | | 533,333 | 13,440 | 3.5 | E 3.3 |
| | (width) | 256,000 | 3,066 | 6.5 | M 264,889 |
| | | 280,533 | 3,093 | 7.0 | T 3,128 |
| | | 258,133 | 3,226 | 8.0 | E 7.2 |
| Orange Cover | (length) | 776,000 | 10,500 | 3.0 | M 788,667 |
| Tag produced | | 788,000 | 10,000 | 3.0 | T 19,467 |
| by Cylinder | | 802,000 | 10,900 | 3.0 | E 3.0 |
| process | (width) | 200,000 | 2,100 | 4.5 | M 202,667 |
| Bristol | | 225,000 | 2,150 | 6.0 | T 2,133 |
| | | 183,000 | 2,150 | 6.0 | E 5.5 |
| Jute Tag | (length) | 800,000 | 14,800 | 2.5 | M 800,533 |
| Stock | | 796,800 | 17,120 | 3.0 | T 16,240 |
| | | 804,800 | 16,800 | 3.0 | E 2.8 |
| | (width) | 341,600 | 3,240 | 5.5 | M 318,133 |
| | | 292,800 | 3,280 | 7.0 | T 3,240 |
| | | 320,000 | 3,200 | 5.5 | E 6.0 |

EXAMPLES VI–VII

Live run testing was conducted at various newspapers to determine the viability of the various paper composites shown in these examples.

EXAMPLE VI

A newspaper plate was made on a 10 point jute stock base coated with a black pigmented solvent type vinyl—Minnesota, Mining and Manufacturing Co. XB5764 coating with carbon black. This was a straight run such that the page image was replicated with a control on aluminum backing.

Run at Bangor Publishing Company, Sept. 14, 1976
Page 5 first, second, third and fourth edition
20,000 impressions total
Printing quality was evaluated as equal to the standard
No structural defects developed
There was no elongation However while the plate printed the entire run with quality as good as its aluminum counterpart, numerous problems were encountered before the plate was produced and mounted on the press.

In applying the tie coat by hand in the lab high plate deformation occurred.
Exposure times were 70 seconds versus 46 seconds on standard aluminum to hold a 0.005" dot.
During processing, several fine lines and letters were lost after air knifing.
The sample could not be used on the automatic Punch/Bend/Trim due to tearing along the bend edge.
The sample could not be mounted on press using the standard lockup procedure due to the very low resistance in tear strength. Full extension of lockup pins would put too much strain on the punched holes. For this reason, it was decided that the only way to maintain a plate on press would be with a spray adhesive. The final plate was mounted using this method and remained on press for 20,000 impressions.

EXAMPLE VII

A letterpress printing plate substrate was prepared by coating a sheet of black tag cover stock with an acrylonitrile-vinylidene chloride copolymer (SARAN F310, a product of Dow Chemical Co.). The black tag cover stock was manufactured by the cylinder process and was 10 point 146 pound basis weight material and exhibited a smooth surface and had a plate finish. It was Riegel 20th Century. The coating was 4.5–6.5 milligrams/sq. inch dry weight and was applied from a methyl ethyl ketone solvent.

The substrate was positioned in a standard LETTERFLEX® 135, a product of W. R. Grace & Co., plate forming machine and 20 mils of liquid Letterflex C polymer, a product of W. R. Grace & Co., photopolymer printing relief forming material was deposited over the coating in the conventional manner. The photopolymer printing relief forming material was then cured in the conventional manner with actinic light projected through a negative on the plate forming machine. The uncured polymer was then stripped from the plate by an air knife which was part of the plate forming machine. The plate was installed on the letterpress and gave printing results that exceeded 70,000 impressions that by visual inspection appeared to be equal to that produced by plates made in the same way using the conventional aluminum substrate.

596 plates were made in the manner of this example and run at Lubbuck, Texas paper between Jan. 29–Feb. 17, 1978. One plate was made with the cover stocks grain running widthwise in the press direction. From this, and considering the results of Example V, it is extrapolated that a minimal preferred tensile strength for mechanical reliability on press would be at least 2,000 psi in the press direction, more preferably 3,000 psi and more preferably 7,000 psi or greater for best performance when calculated according to the procedure of Example V. The substrate was 10 point stock and therefore it is calculated that the minimum tensile strength would be 20 pounds per inch in width in the cross machine direction—2,000 psi divided by the thickness in inches which is 0.01 inches which is 10 mils because the board is 10 point board. The minimum tensile strength would be 30 pounds per inch in width in the machine direction—3,000 psi divided by the thickness in inches which again is 0.01 inches which is 10 mils because the board is 10 point board. Using the same procedure of calculation, the more preferred machine direction tensile strength would be at least 70 pounds per inch in width.

EXAMPLE VIII

A letterpress printing plate substrate was prepared by coating the cover stock of Example VII as described in Example VII.

The substrate was positioned in a standard LETTERFLEX® 290, a product of W. R. Grace & Co., plate forming machine and 20 mils of liquid Letterflex Y polymer, a product of W. R. Grace & Co., photopolymer printing relief forming material was deposited over the coating in the conventional manner. The photopolymer printing relief forming material was then cured in the conventional manner with actinic light projected through a negative on the plate forming machine. The uncured polymer was then stripped from the plate by an air knife which was part of the plate forming machine. The plate was then installed on a letterpress and gave printing results that exceeded 280,000 impressions with no deleterious effects. 70 wraps were applied and the plates printed well after being cleared. The plate showed little or no evidence of wear while stereotype plates with comparable impressions showed signs of wear to visual observation.

EXAMPLE IX

The letterpress printing plate substrate of Example VII was used except the coating was DARAN® 229, a polyvinylidene chloride latex produced by W. R. Grace & Co.

A plate formed in the manner of Example VII gave good performance.

EXAMPLE X

A tag stock made up to order, as 10 point stock and colored a deep purplish tinted scarlet red made on a Fourdrinier machine and obtained from the Plainwell Paper Co., Plainwell, Michigan, was compared with the substrate, Regal 20th Century Black 10 point cover stock of Example I. In both instances the polymer used was LETTERFLEX® Y polymer which is made according to U.S. Pat. No. 4,120,721. The new red tag stock was found to require a slightly shorter exposure time typically 45 seconds verses 55 seconds and to provide equal quality print from visual comparison at four test accounts. At two of the test accounts, a standard LETTERFLEX® 290 Platemaking System was used. There is a present subjective view that stabilization of half-tones was improved a little better with the red cover stock. The finished plate also was easier to inspect before mounting on the press and after being on the press because of the contrast between the black ink and the red substrate.

It will be obvious to those skilled in the art that various changes and modifications may be made in the invention without departing from its true spirit and scope. It is, therefore, aimed in the appended claims to cover all such equivalent variations as fall within the true spirit and scope of the invention.

It is claimed:

1. In the method for preparing a letterpress printing plate consisting essentially of positioning a substrate for receipt of a liquid light polymerizable composition, depositing said liquid light polymerizable composition on said substrate, exposing said liquid light polymerizable composition to light with a patterning means to polymerize said light polymerizable composition and form a latent relief image in said liquid light polymerizable composition and mechanically removing the unpolymerized liquid light polymerizable composition with a liquid free procedure, the improvement comprising said substrate consisting essentially of a paper laminae having a side on which the liquid light polymerizable composition is deposited and a polymeric sealing laminae sealing said side of said paper laminae on which said liquid light polymerizable composition is deposited, said paper lamina characterized by cellulosic pulp and consisting of a single sheet of smooth finish tag stock that is 5 to 20 mils thick, has a tensile strength in the press direction of at least 70 pounds per inch in width, a tensile strength in the cross press direction of at least 20 pounds per inch in width and having dark colored fibers independently colored with a dark color having a good ultraviolet light absorption/reflectivity ratio before being incorporated into said sheet.

2. The method of claim 1 wherein said polymeric sealing laminae is substantially clear.

3. The method of claim 1 wherein said mechanical removal of the unpolymerized liquid light polymerizable composition is with an air knife.

4. The method of claim 1 wherein said polymeric sealing laminae is a vinyl tie coat.

* * * * *